US008790035B2

(12) United States Patent
Scott, Sr.

(10) Patent No.: US 8,790,035 B2
(45) Date of Patent: Jul. 29, 2014

(54) FLOW-THRU LIQUID COATING APPLICATOR

(75) Inventor: John L. Scott, Sr., Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 735 days.

(21) Appl. No.: 13/051,338

(22) Filed: Mar. 18, 2011

(65) Prior Publication Data

US 2012/0234232 A1 Sep. 20, 2012

(51) Int. Cl.
*A47L 13/22* (2006.01)

(52) U.S. Cl.
USPC ..... 401/289; 401/9; 401/28

(58) Field of Classification Search
USPC ..... 401/9–11, 16, 23, 28, 29, 270, 289; 15/160, 164, 165
See application file for complete search history.

(56) References Cited

U.S. PATENT DOCUMENTS

| | | | | |
|---|---|---|---|---|
| 1,598,742 | A * | 9/1926 | Parker | 401/10 |
| 2,756,452 | A * | 7/1956 | Nielsen | 15/179 |
| 3,133,298 | A * | 5/1964 | Norwood | 15/164 |
| 3,640,630 | A | 2/1972 | Walker | |
| 3,826,581 | A | 7/1974 | Henderson | |
| 3,933,415 | A | 1/1976 | Woolpert | |
| 4,676,685 | A | 6/1987 | Murphy | |
| 4,790,679 | A | 12/1988 | Murphy | |
| 5,269,684 | A | 12/1993 | Fischer | |
| 5,483,721 | A | 1/1996 | Caldwell | |
| 5,496,123 | A | 3/1996 | Gaither | |
| 6,082,921 | A | 7/2000 | Caldwell | |
| 6,749,356 | B1 | 6/2004 | Mead et al. | |
| 7,407,336 | B2 | 8/2008 | Giacomo | |
| 2004/0117933 | A1 * | 6/2004 | Tubman | 15/160 |

* cited by examiner

*Primary Examiner* — David Walczak
(74) *Attorney, Agent, or Firm* — Renner, Otto, Boisselle & Sklar, LLP

(57) ABSTRACT

A flow-thru liquid coating applicator comprises a handle and an applicator head including a blade having a filament bundle extending crosswise adjacent the distal end of the blade. A cover surrounds the distal end of the blade and a substantial portion of the length of the blade and has side openings through which opposite end portions of the filament bundle extend.

20 Claims, 5 Drawing Sheets

FLOW-THRU LIQUID COATING APPLICATOR

FIELD OF THE INVENTION

The present invention relates generally to a flow-thru liquid coating applicator for applying viscous coating materials to difficult to access surfaces.

SUMMARY OF THE INVENTION

The applicator of the present invention is primarily intended for use in applying viscous coating materials including, for example, marine and military paints/coatings to difficult to access surfaces. An example of a difficult to access surface would be the underside of tie-downs on the flight deck of aircraft carriers. The coating applicator includes a hose fitting/connector to which a hose may be connected for supplying a coating material from a dispenser that mixes and discharges multi-component fluid compositions such as high solid paints under pressure. An example of such a multi-component paint dispenser is disclosed in U.S. Pat. No. 7,144,170, the entire disclosure of which is incorporated herein by reference.

The applicator of the present invention comprises a handle and an applicator head including a blade having a filament bundle extending crosswise adjacent the distal end of the blade and protruding laterally outwardly beyond opposite side edges of the blade.

In accordance with one aspect, a cover surrounds the distal end of the blade and a substantial portion of the length of the blade.

In accordance with another aspect, opposite end portions of the filament bundle extend laterally outwardly through side openings in the cover.

In accordance with another aspect, a flow-thru port adjacent the distal end of the blade provides for flow of a viscous coating material out through the opposite end portions of the filament bundle.

In accordance with another aspect, the cover is made of a permeable material that is sufficiently porous to allow at least some of the liquid coating material to soak through the cover material.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
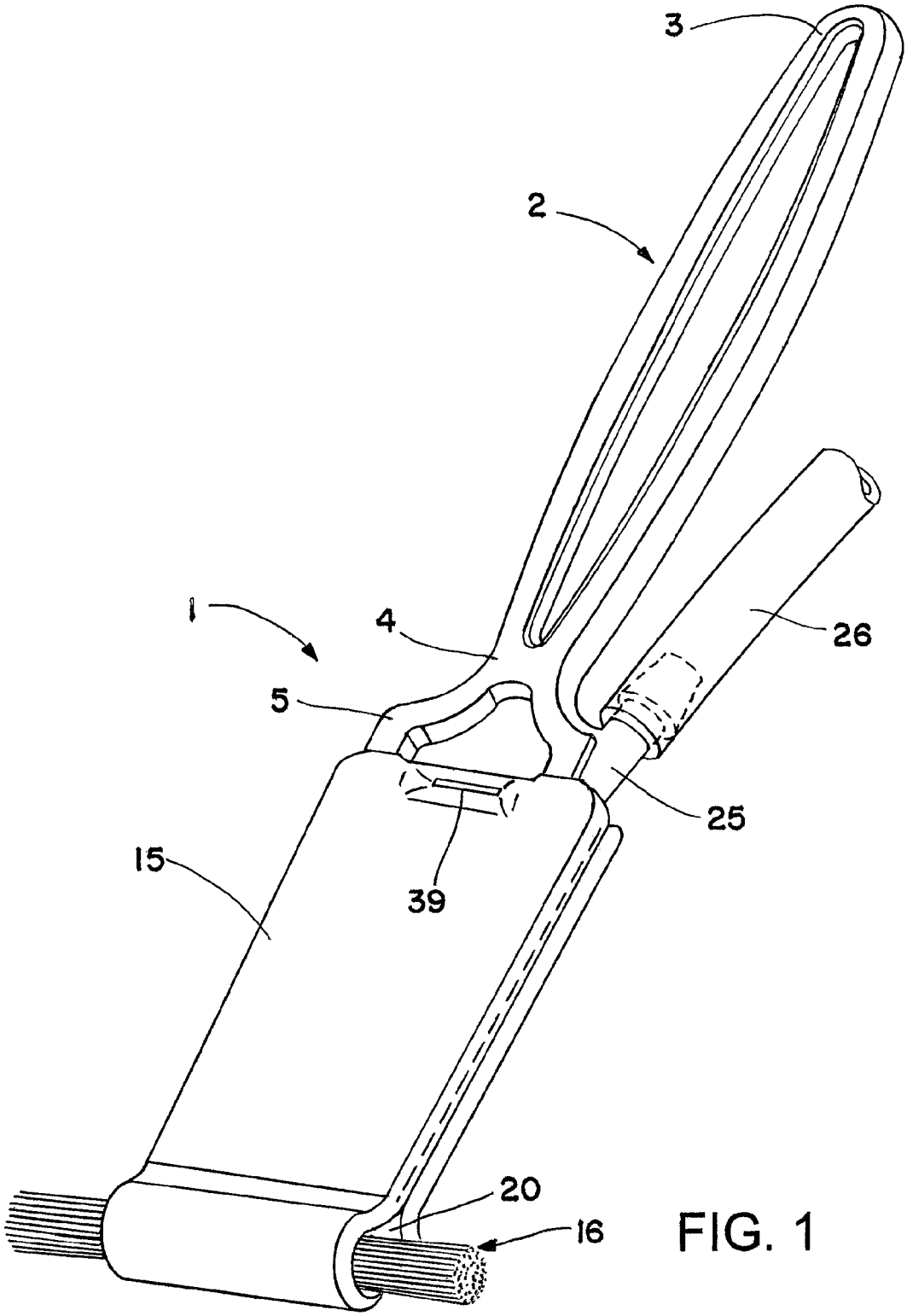
FIG. 1 is a schematic perspective view of one flow-thru liquid coating applicator embodiment of the present invention.
Figure 2:
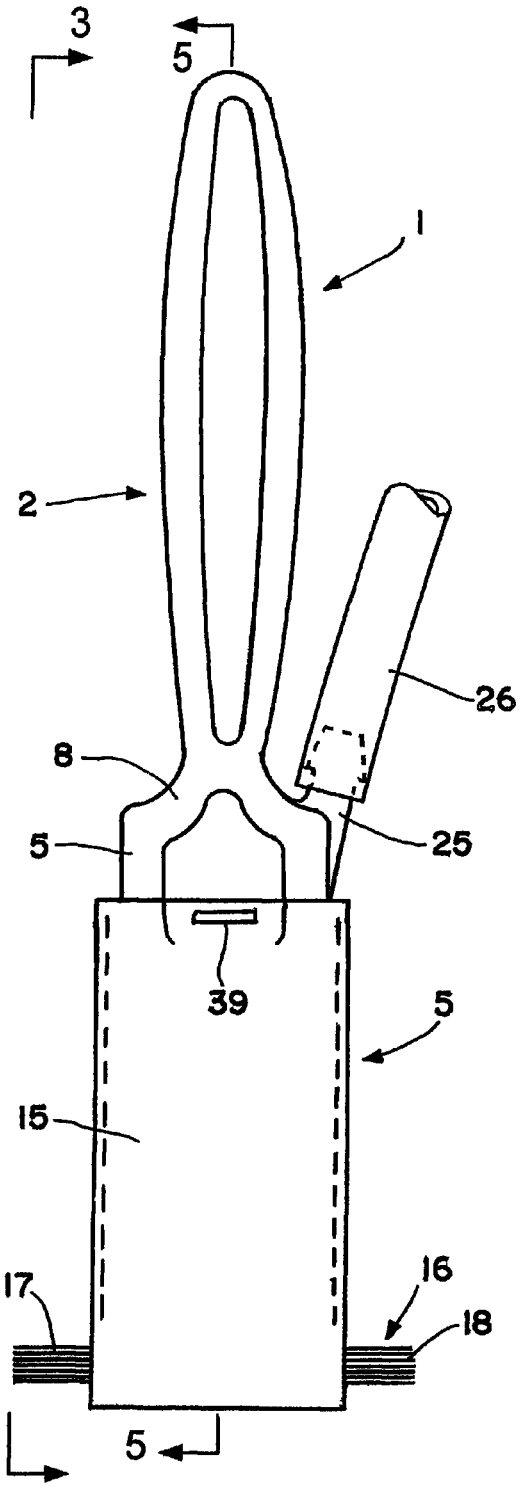
FIG. 2 is a schematic front view of the applicator of FIG. 1.
Figure 3:
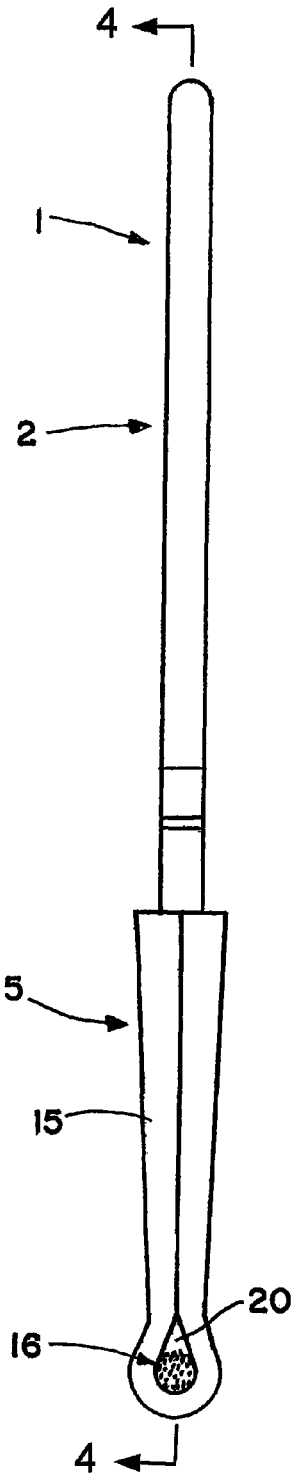
FIG. 3 is a schematic side view of the applicator of FIG. 1.
Figure 4:
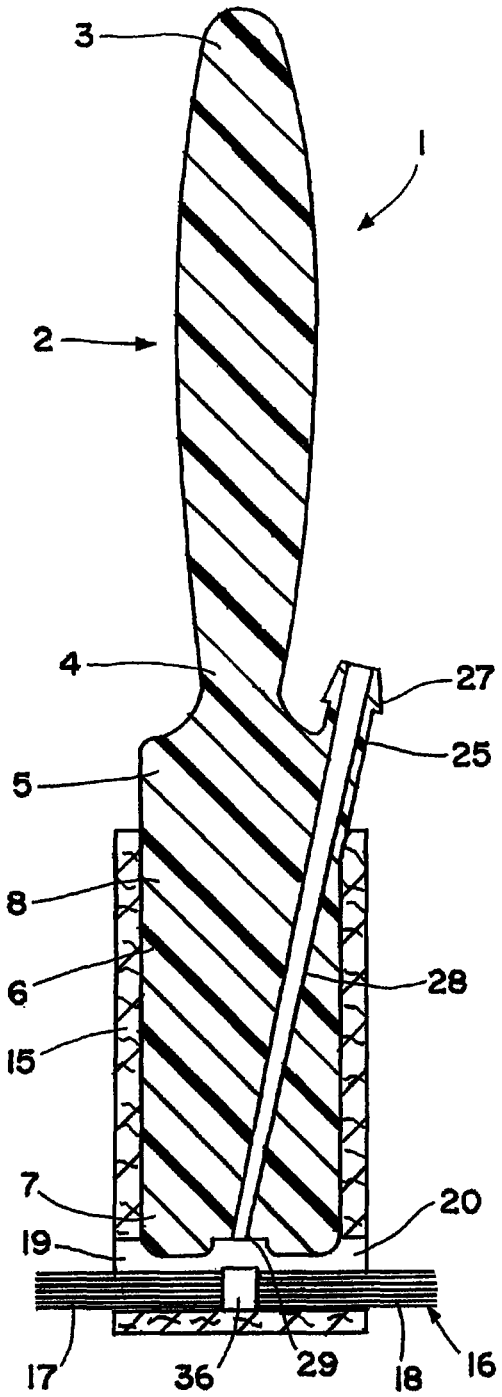
FIG. 4 is a schematic longitudinal section through the applicator of FIG. 3, taken on the plane of the line 4-4 thereof.
Figures 6, 7:
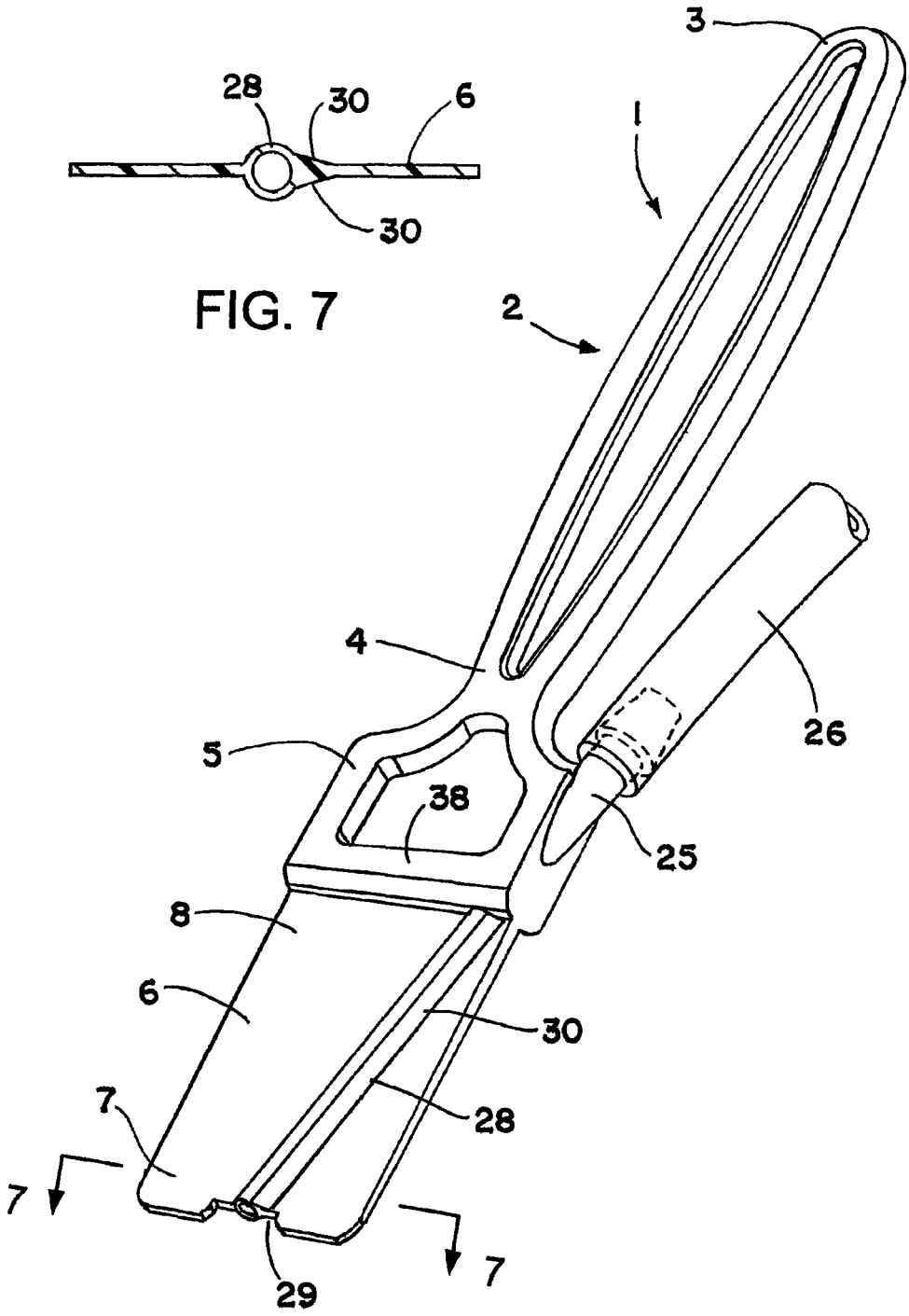
FIG. 6 is a schematic perspective view of the applicator similar to FIG. 1, but with the cover and filament bundle portions of the applicator removed.
FIG. 7 is an enlarged schematic transverse section through the blade portion of the applicator of FIG. 6, taken on the plane of the line 7-7 thereof.

Referring now in detail to the drawings, and initially to FIGS. 1-3, there is shown an example of a flow-thru liquid coating applicator embodiment 1 of the present invention. Applicator 1 comprises a handle 2 having a proximal end 3 and a distal end 4, and an applicator head 5 at the distal end of the handle. The applicator head 5 includes a flexible blade 6 which, as shown in FIGS. 4 and 6, has a distal end 7 and a proximal end 8.

A cover 15 surrounds the distal end 7 of the blade 6 and a substantial portion of the length of the blade. Extending crosswise adjacent the distal end of the blade 6 is a filament bundle 16. Filament bundle 16 has opposite end portions 17, 18 extending through side openings 19, 20 in the cover and laterally outwardly beyond opposite side edges of the blade. The applicator handle 2 and applicator head 5 including blade 6 may be integrally molded out of a suitable flexible plastic material such as polyethylene to provide flexibility and strength. Also blade 6 is desirably tapered for controlling the flexibility of the blade.

Adjacent the proximal end of the applicator head 5 is a hose fitting/connector 25 to which a hose 26 (see FIGS. 1, 2 and 6) may be connected for supplying the coating material from a source under pressure. Hose fitting 25 may be integrally molded on the applicator head and may include a molded-on hose barb 27 (see FIG. 4) that eliminates the need for other hose fittings. Hose fitting 25 is in fluid communication with a tube 28 molded in the applicator head and flexible blade 6 for supplying the liquid coating material to a flow-thru port 29 at the approximate center of the width of the distal end of the blade within the cover 15. The flow-thru port 29 may be formed by a notch or slot in the distal end of the blade (see FIGS. 4 and 6). Liquid coating material exiting the flow-thru port 29 will flow out through the opposite end portions 17, 18 of the filament bundle 16 by capillary action. Tube 28 may have a wedge shape fillet 30 along at least one side of the tube on one or both sides of the blade (see FIG. 7) for added strength and to prevent the tube from pinching off when the blade is flexed.

Cover 15 may be made of a suitable non-woven polyester or polymeric material such as nylon filament for greater wear resistance and that resists shedding even when used with viscous coatings on rough surfaces. Also such cover material may be ultrasonically die cut to seal the edges when cut to greatly reduce the amount of stray fibers, and may be securely ultrasonically stitched together along the edges of the fabric cover to reduce potential fiber loss. However, other natural or synthetic fibers may also be used for the cover. Also, the cover may be made out of a suitable porous foam type material.

Figure 5:
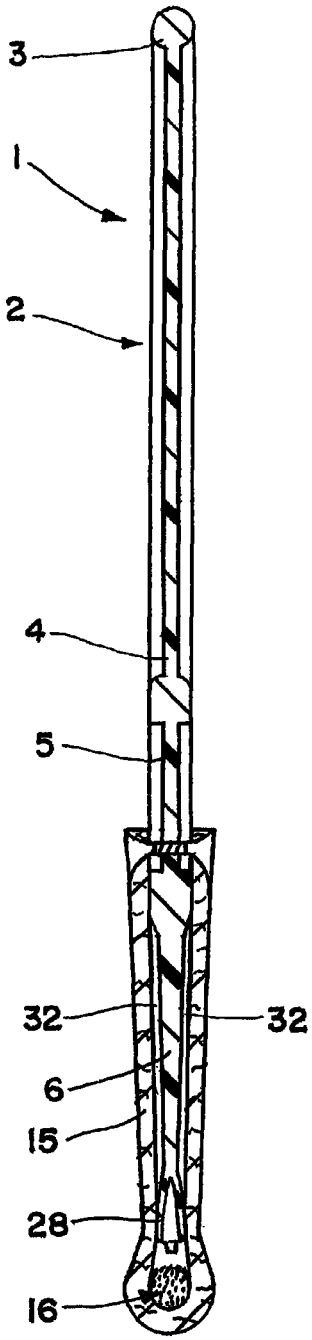
FIG. 5 is a schematic longitudinal section through the applicator of FIG. 2, taken on the plane of the line 5-5 thereof.

Regardless of the material used to make the cover 15, the material should be a permeable material that is sufficiently porous to allow at least some of the liquid coating material to soak through the cover material. Also as seen in FIG. 5, a clearance space 32 is provided between the cover 15 and a substantial portion of the length of the blade 6 for flow of the liquid coating material into the clearance space and soaking of the liquid coating material out through the cover over a substantial portion of the length of the blade. The rate at which the coating material soaks through the cover material will vary depending on the viscosity of the coating material and the rate at which the applicator is loaded up with the coating material.

Figure 8:
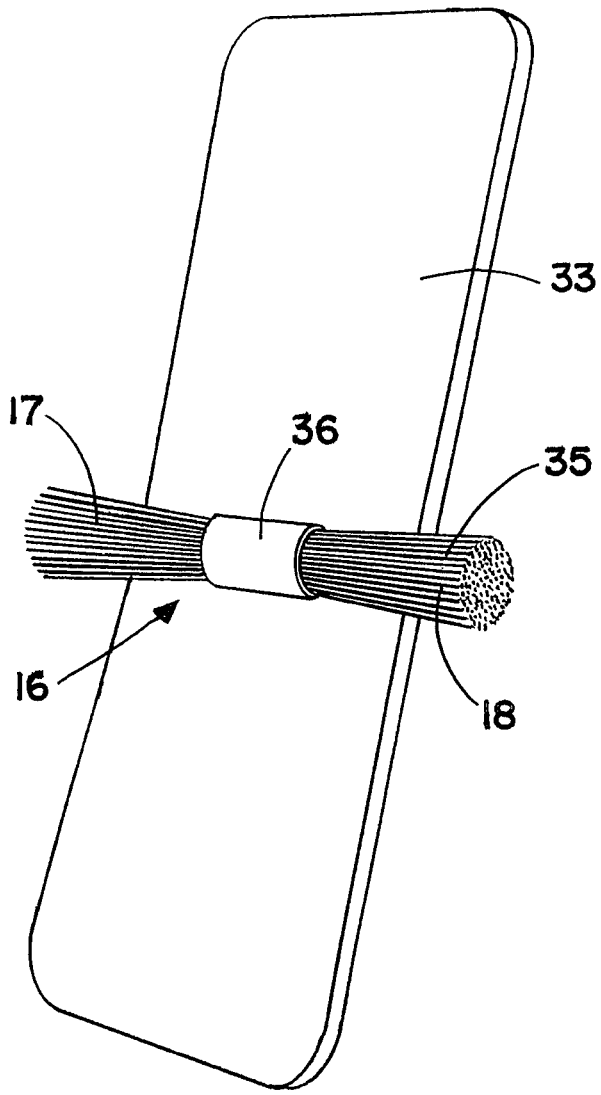
FIG. 8 is an enlarged schematic perspective view of exemplary cover material and filament bundle that may be used to make a cover and fiber bundle assembly for the applicator.

After the cover material 33 has been die cut to the desired size and shape, but before the cover material is folded over and the side edges are stitched together, the filament bundle 16, which comprises filaments 35 securely crimped into a ferrule 36 intermediate their length, may be secured to the midpoint of the cover material as shown in FIG. 8 as by applying hot melt adhesive to the cover material and pressing the ferrule against the adhesive. Thereafter the cover material may be folded over on itself with the filament bundle 16 inside the fold and the side edges of the cover material stitched together to form the cover 15. Once formed, the cover 15 may then be slid over the distal end of the blade 6 and stretched over a thicker section 38 of the applicator head 5 adjacent the proximal end 8 of the blade and secured in place as by stapling the open end of the cover at 39 to the proximate center of the thicker section (see FIGS. 1 and 2). Alternatively, the cover 15 may be secured to the applicator head 5 by other means including but not limited to hot melt adhesive or ultrasonic stitching or the like.

During use, the applicator is loaded up by supplying the liquid coating material to the hose fitting under pressure on demand. During loading, capillary action will cause the liquid coating material to flow out through opposite ends of the filament bundle. Also the liquid coating material will fill the clearance space between the cover and blade and soak through the cover over a substantial portion of its length. Once loaded, the cover is capable of retaining a significant amount of liquid coating material without dripping.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms used to describe such components are intended to correspond, unless otherwise indicated, to any component which performs the specified function of the desired component (e.g., that is functionally equivalent), even though not structurally equivalent to the disclosed component which performs the function of the herein disclosed exemplary embodiment of the invention. In addition, while a particular feature of the invention may have been disclosed with respect to only one embodiment, such feature may be combined with one or more other features as may be desired and advantageous for any given or particular application.

What is claimed is:

1. A flow-thru liquid coating applicator comprising a handle having a proximal end and a distal end, an applicator head at the distal end of the handle, the applicator head including a blade having a distal end and a proximal end, a cover surrounding the distal end of the blade and at least a portion of the length of the blade, and a filament bundle extending crosswise adjacent the distal end of the blade inside the cover, the filament bundle having opposite end portions extending through side openings in opposite sides of the cover and laterally outwardly beyond opposite side edges of the blade.

2. The applicator of claim 1 further comprising a tube for supplying a liquid coating material to the filament bundle within the cover for flowing out through the opposite end portions of the filament bundle.

3. The applicator of claim 2 wherein the cover is made of a permeable material that is sufficiently porous to allow at least some of the liquid coating material to soak through the cover material.

4. The applicator of claim 3 wherein there is a clearance space between the cover and a substantial portion of the length of the blade for flow of the liquid coating material into the clearance space and soaking of the liquid coating material through the cover over a substantial portion of the length of the blade.

5. The applicator of claim 4 wherein the cover is fixedly secured to the applicator head.

6. The applicator of claim 4 wherein the cover is made of a non-woven polyester or polymeric material that resists shedding even when used with viscous liquid coating materials on rough surfaces.

7. The applicator of claim 6 wherein the cover has ultrasonically die cut side edges to reduce the amount of stray fibers.

8. The applicator of claim 6 wherein the cover has side edges that are ultrasonically stitched together to minimize potential fabric loss.

9. The applicator of claim 4 wherein the cover is made of a porous foam type material.

10. The applicator of claim 2 further comprising a flow-thru port at the distal end of the blade in fluid communication with the tube.

11. The applicator of claim 10 wherein the flow-thru port is at an approximate center of a width of the distal end of the blade.

12. The applicator of claim 10 wherein the flow-thru port is formed by a notch or slot in the distal end of the blade.

13. The applicator of claim 2 wherein the tube is integrally molded with the blade.

14. The applicator of claim 13 wherein the blade is molded out of a flexible plastic material and is tapered for controlling the flexibility of the blade.

15. The applicator of claim 14 further comprising a wedge shape fillet along at least one side of the tube on opposite sides of the blade for added strength and to prevent the tube from pinching off during flexing of the blade.

16. The applicator of claim 14 wherein the proximal end of the blade has a molded in hose fitting in fluid communication with the tube.

17. The applicator of claim 1 wherein the filament bundle is secured intermediate its length to an inner surface inside the cover at a midpoint of the cover.

18. A flow-thru liquid coating applicator comprising a handle having a proximal end and a distal end, an applicator head at the distal end of the handle, the applicator head including a flexible blade having a proximal end and a distal end, a cover surrounding the distal end of the blade and at least a portion of the length of the blade, and a filament bundle extending crosswise adjacent the distal end of the blade inside the cover, the filament bundle having opposite end portions extending through side openings in the cover and laterally outwardly beyond opposite side edges of the blade, and a flow-thru port adjacent the distal end of the blade for supplying a liquid coating material to the filament bundle inside the cover for flow out through the opposite end portions of the filament bundle.

19. The applicator of claim 18 wherein there is a clearance space between the cover and a substantial portion of the length of the blade for flow of the liquid coating material into the clearance space, and the cover is made of a permeable material that is sufficiently porous to allow at least some of the liquid coating material to soak through the cover material over a substantial portion of the length of the blade.

20. The applicator of claim 19 wherein the blade is molded out of a flexible plastic material and is tapered for controlling the flexibility of the blade, and a tube is integrally molded into the blade for supplying the liquid coating material to the flow-thru port at the distal end of the blade.

* * * * *